US008496811B2

(12) United States Patent
Cohen

(10) Patent No.: US 8,496,811 B2
(45) Date of Patent: Jul. 30, 2013

(54) DRAIN LOCKING DEVICE FOR FLOOR DRAINS

(75) Inventor: Todd R. Cohen, Chatsworth, CA (US)

(73) Assignee: TNT Products, LLC, Chatsworth, CA (US)

( * ) Notice: Subject to any disclaimer, the term of this patent is extended or adjusted under 35 U.S.C. 154(b) by 0 days.

(21) Appl. No.: 13/365,965

(22) Filed: Feb. 3, 2012

(65) Prior Publication Data

US 2012/0199215 A1 Aug. 9, 2012

Related U.S. Application Data

(60) Provisional application No. 61/462,511, filed on Feb. 4, 2011.

(51) Int. Cl.
*E03F 5/14* (2006.01)

(52) U.S. Cl.
USPC ..... 210/163; 210/232

(58) Field of Classification Search
None
See application file for complete search history.

(56) References Cited

U.S. PATENT DOCUMENTS

| | | | | | |
|---|---|---|---|---|---|
| 3,802,001 | A * | 4/1974 | Richards | 4/287 |
| 4,035,297 | A * | 7/1977 | Aldridge et al. | 210/163 |
| 4,276,662 | A * | 7/1981 | Young | 4/295 |
| 4,799,713 | A * | 1/1989 | Uglow | 285/42 |
| 5,141,633 | A * | 8/1992 | Walczak et al. | 210/163 |
| 5,369,815 | A * | 12/1994 | Martin | 4/287 |
| 5,695,222 | A * | 12/1997 | Hodges | 285/3 |
| 6,108,828 | A * | 8/2000 | Cheng | 4/287 |
| 6,165,357 | A * | 12/2000 | Cormier | 210/163 |
| 7,013,500 | B1 * | 3/2006 | Lin | 4/287 |
| D553,225 | S * | 10/2007 | Wolf | D23/261 |
| 7,618,532 | B2 * | 11/2009 | Worth | 210/164 |
| 7,887,697 | B2 * | 2/2011 | Worth | 210/164 |
| 2003/0182721 | A1 * | 10/2003 | Li | 4/287 |
| 2004/0073992 | A1 * | 4/2004 | Saman et al. | 4/287 |
| 2008/0295236 | A1 * | 12/2008 | Eichler et al. | 4/292 |
| 2011/0240536 | A1 * | 10/2011 | Tseng et al. | 210/136 |
| 2012/0199215 | A1 * | 8/2012 | Cohen | 137/362 |

* cited by examiner

*Primary Examiner* — Robert James Popovics
(74) *Attorney, Agent, or Firm* — Gregory B. Wood; Feldman Gale, P.A.

(57) ABSTRACT

A locking drain device for a floor drain comprises a top strainer, a cylindrical middle section having spreadable sides with slits in them, a frustoconical spreader, and a locking bolt, such that, when the spreader is drawn against the spreadable sides of the cylindrical middle section by tightening the locking bolt, the cylindrical sides will be spread to frictionally engage against the internal surface of a drain pipe to prevent inadvertent removal of the floor drain.

5 Claims, 3 Drawing Sheets

DRAIN LOCKING DEVICE FOR FLOOR DRAINS

CROSS REFERENCE TO RELATED APPLICATIONS

This application claims the benefit of U.S. Provisional Application No. 61/462,511 filed Feb. 4, 2011, the disclosure of which is hereby incorporated herein by reference in its entirety.

This invention relates to plumbing devices and is particularly directed to improved floor drains which can be installed without the need for external access to the drain pipe. The floor drain of this invention can be installed solely by accessing the concrete-embedded floor drain from above, and has openings which prevent the passage of large objects, while allowing fluid to flow through the drain.

BACKGROUND

Floor drains and built-in sink drains are generally installed at the time a structure is built, or during reconstruction when a new floor is being installed. Where concrete supports the built-in sink or flooring material, the floor drain must be installed at the time the concrete is poured. Once a floor drain has been poured, it may be difficult or impossible to replace or repair without tearing up the supporting substructure which, in many cases, requires that the concrete be broken up and removed before repairs can take place. Once repairs have been completed, a re-pour of concrete around the drain is required to provide support for normal operations. What is needed is a floor drain that can be installed or replaced without the necessity of removing and replacing the concrete or other substance that supports the drain pipe and drain.

SUMMARY OF THE INVENTION

The locking drain of this invention has three (3) components that are held together by means of a bolt running down the center. A first component is the strainer at the top of the device which may be any material, but preferably is steel or some other material having sufficient strength to withstand the stress of being coupled to the remaining components, and to support normal weight that may be associated with objects placed on a floor. The strainer has an unthreaded center hole for a tamperproof bolt to sleeve through and a plurality of drain holes to allow water to pass through while obstructing large objects or particulates that could clog the drain. This component can be square or round depending on the need.

A second component comprises a middle section which can be made from any slightly malleable or resilient material, and is attached at its upper end to the strainer. This component is cylindrical and has a diameter that is slightly smaller than the drain pipe within which it will be installed. It acts like a skirt offset from the strainer, and the lower portion of the component has one or more splits that permit the lower portion to be spread apart to contact the inner surface of the drain pipe. In some embodiments, the bottom end of the second component is open and the top end is closed and perforated with a plurality of holes that align with the drain holes of the strainer.

The third component is a spreader that is circular in form and that can be made of any generally rigid material. The spreader may have differing circumferences, depending on the size drain it services, and the circumferential edge has a frustoconical taper in which the larger end is farthest from the strainer. In some embodiments, the spreader has a generally hollow interior portion that may be formed by a plurality of holes. The center of the spreader has a threaded nut, which may or may not be integrally formed with the spreader, to receive the locking bolt and allow it to pass through and to tighten the spreader against the other two components.

DETAILED DESCRIPTION OF THE PREFERRED EMBODIMENTS

Figure 1:
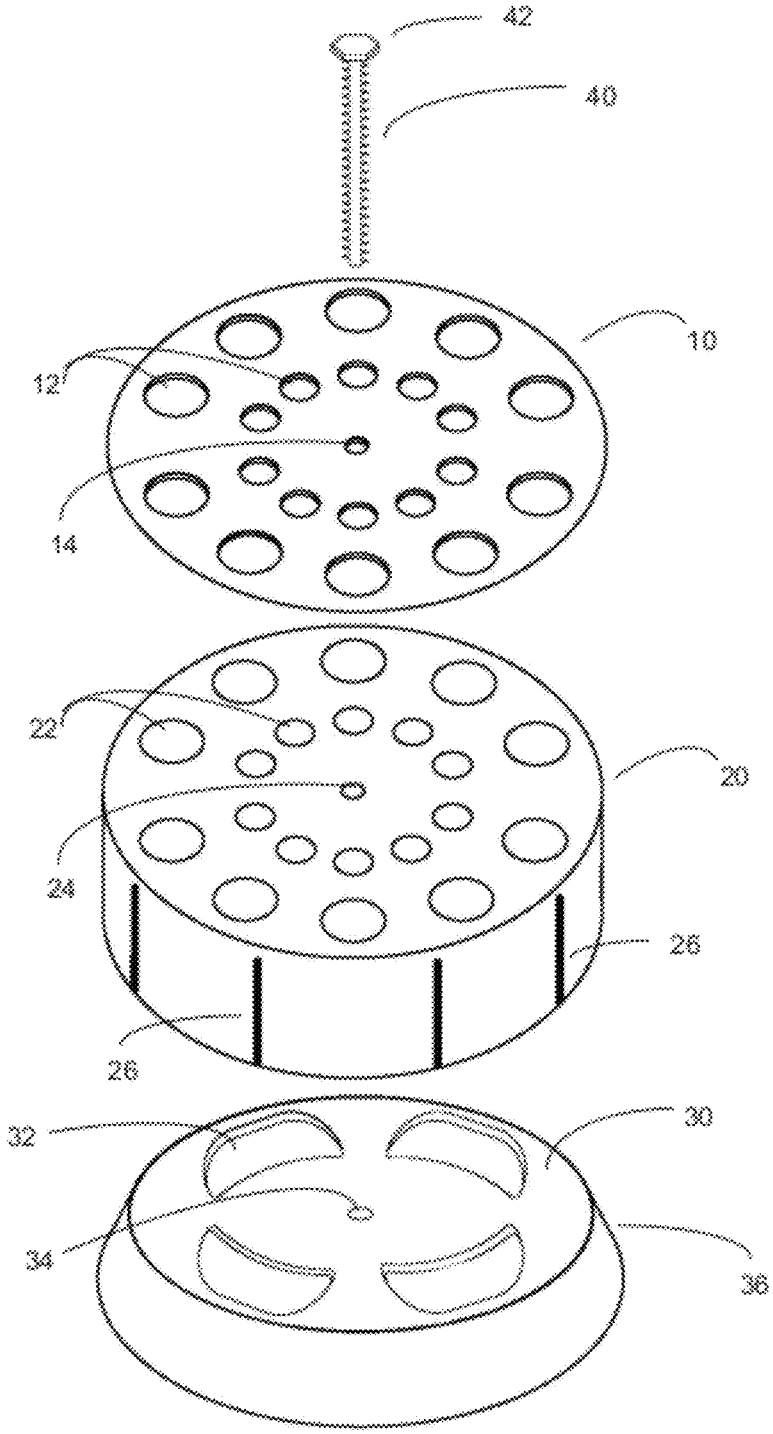
FIG. 1 is an exploded perspective view of the locking drain device of the invention.

An exploded view of the locking drain device is shown in FIG. 1. A strainer 10 has a plurality of holes 12 through which water or any other fluid will pass on its way to a drain pipe (not shown). An unthreaded hole 14 receives locking bolt 40, but is not attached to the bolt other than to prevent it from passing through the hole 14. This may be accomplished if head 42 of bolt 40 is larger than the diameter of hole 14, or if a washer (not shown) is used. Strainer 10 may be of any desired shape, which may depend upon the configuration of the floor and space around the floor.

As depicted in FIG. 1, the middle section can be a cylinder any length, and will have differing circumferences depending on the size of drain in which it is being used. The diameter of the cylinder must be slightly smaller than the diameter of the drain pipe, and the sides of the cylinder have one or more slits 26 which may be spread to contact the inner surface of the drain pipe. A moderately malleable or flexible material may be used to form the cylinder walls which are to be spread although the material must have sufficient rigidity to maintain pressure against the drain pipe when the sides of the cylinder are spread. In an embodiment, a plurality of slits 26 begins at the bottom of the cylinder and extends toward, but does not reach, the top of the cylinder. In another embodiment, the cylinder has a perforated top whose holes 22 align with corresponding holes 12 in the strainer. In this embodiment, a pin or other extending structural element (not shown) may be used to align and lock the holes 22 in the top of the cylinder with the holes 12 of the strainer so that the strainer cannot freely turn and cause the holes to move out of alignment. The slits 26 allow for the cylindrical walls to flare open at the bottom while the top section maintains its original shape.

The third component, spreader 30, can be any height and has a frustoconical circumference 36. Holes or cavities 32 allow water to drain through the spreader and into the drain pipe. In a preferred embodiment, center hole 34 will be threaded to receive locking bolt 40. Alternatively, a separate locking nut and washer may be used beneath spreader 30 although, in this embodiment, a further mechanical attachment must be employed to hold the nut against the bottom of the spreader, and to prevent it from turning independently when bolt 40 is tightened or loosened.

Figure 2:
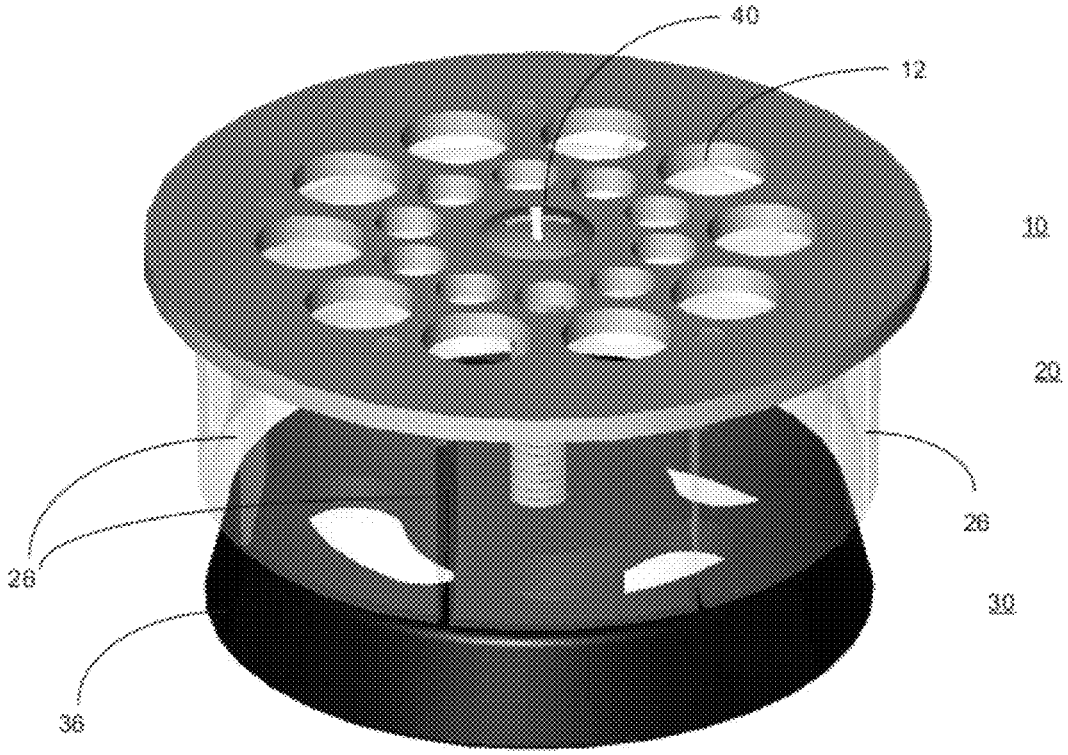
FIG. 2 is an upper perspective view of the assembled components of the invention.
Figure 3:
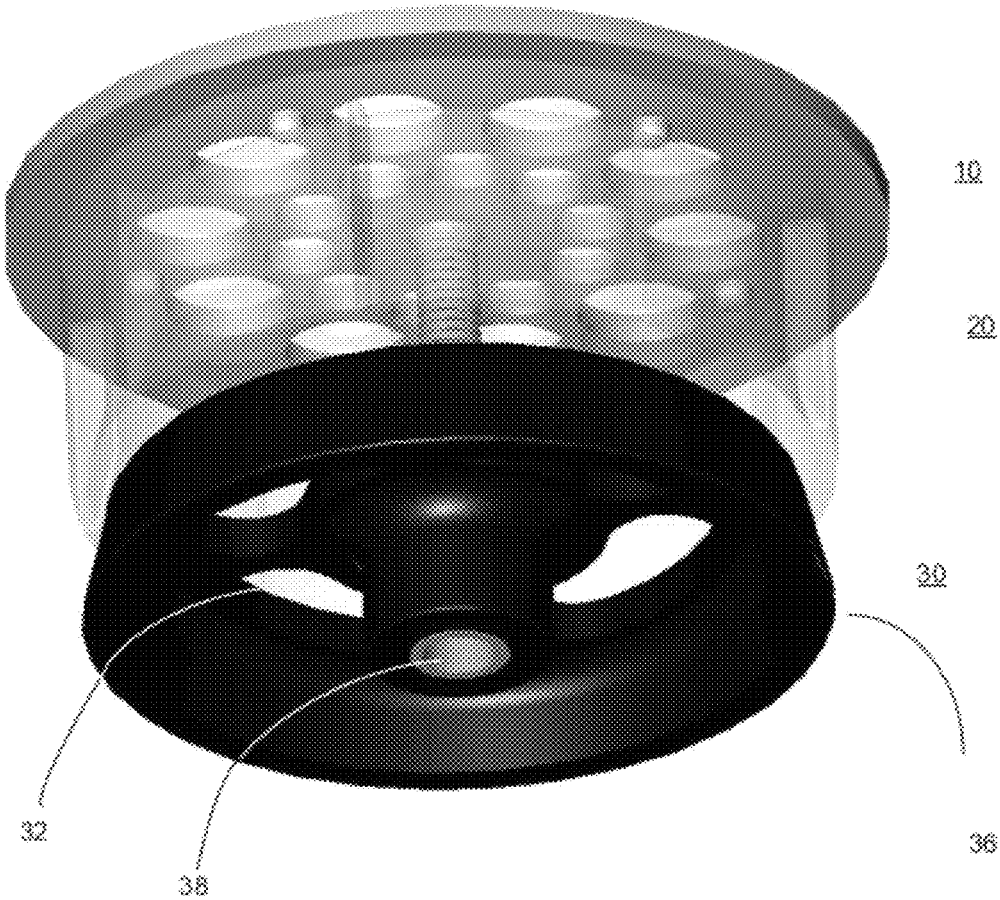
FIG. 3 is a lower perspective view of the assembled components of the invention.

FIG. 2 is a perspective view of the invention as seen from above. When the three components are assembled, bolt 40 runs through the center of the strainer 10, the cylindrical middle section 20, and is received by a nut in the center of the spreader 30. When bolt 40 is tightened, the spreader 30 is pulled upward until the small end of the tapered frustoconical section 36 of the spreader is received into the bottom of the cylindrical middle section 20. As the bolt continues to pull the spreader up, the larger end of the frustoconical section 36 causes the sides of the cylindrical middle section 20 to flare apart and outwardly along splits 26. When the assembly is placed into a drain pipe, and is then tightened and flared, the flaring action of the middle section 20 wedges itself against the drain pipe wall, where friction prevents it from being removed without being disassembled using a tool. The strainer 10 may be flanged over the top of the drain pipe opening to prevent any of the components from falling into the drain.

While several embodiments have been shown and described in accordance with the present invention, it is to be understood that the same is not limited thereto, but is susceptible to numerous changes and modifications as would be known to persons skilled in the art, and there is no intention that this specification be so limited, but it is intended to cover all such changes and modifications as are obvious to one of ordinary skill in the art. For example, a separate nut may be substituted for the threaded hole of the spreader without changing the effectiveness of the invention; and slits in the cylindrical middle section may be a single slit or a plurality of slits, and may run helically around the circumference of the cylinder rather than vertically, without changing the function or operation of the invention.

I claim:

1. A drain locking device for affixing floor drains to a drain pipe comprising:

A strainer, a cylindrical middle section, a spreader, and a locking bolt, said strainer having a diameter greater than the diameter of the drain pipe in which said drain locking device is to be installed and further comprising drainage holes and a non-threaded center hold for receiving said locking bolt;

said cylindrical middle section having a diameter smaller than the diameter of the drain pipe and further comprising a top and sides, said top having drainage holes and a non-threaded center hole for receiving said locking bolt, said sides having one or more splits, said sides being of sufficient length and being spreadable such that, when said cylindrical middle section is installed within the drain pipe, said sides will contact and press against the inner surface of the drain pipe;

said spreader comprising a disc of sufficient height to form a frustoconical surface and having a largest diameter that is smaller than the diameter of the drain pipe and larger than the diameter of said cylindrical middle section, said spreader having one or more holes for allowing fluid to pass therethrough and a center hole for receiving said locking bolt, said locking bolt extending through said center hold of said strainer, said center hold of said cylindrical middle section, and said center hole of said spreader, and being secured to said spreader with threaded means, whereby, when said locking bolt is tightened, said spreader is raised such that said frustoconical surface of said spreader contacts the lower circumferential edge of said cylindrical middle section, and upon further tightening causes said circumferential edge to spread and contact the inner surface to form a frictional engagement that prevents the inadvertent removal of said drain locking device from said drain pipe.

2. The drain locking device claimed in claim 1, further comprising said slits extending from the bottom of the edge of said cylindrical middle section generally vertically and ending near the top of said cylindrical middle section.

3. The drain locking device claimed in claim 1, further comprising said slits extending from the bottom of the edge of said cylindrical middle section helically and ending near the top of said cylindrical middle section.

4. The drain locking device claimed in claim 1 wherein, when installed, said holes of said strainer are aligned with said holes of said cylindrical middle section.

5. The drain locking device claimed in claim 1, further comprising said center hole of said spreader being threaded and being secured in threaded engagement to said threaded locking bolt.

* * * * *